US011450302B2

(12) United States Patent
Weber et al.

(10) Patent No.: US 11,450,302 B2
(45) Date of Patent: Sep. 20, 2022

(54) LOUDSPEAKER WITH MAGNETS IN FERROFLUID

(71) Applicant: Harman International Industries, Incorporated, Stamford, CT (US)

(72) Inventors: Guenther Weber, Kelheim (DE); Gilles Milot, Paris (FR); Marc-Olivier Chauveau, Saint-Cyr-sur-Loire (FR); Ludovic Fournier, Chateau du Loir (FR); Armin Prommersberger, Karlsbad (DE)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/978,404

(22) PCT Filed: Mar. 7, 2019

(86) PCT No.: PCT/US2019/021095
§ 371 (c)(1),
(2) Date: Sep. 4, 2020

(87) PCT Pub. No.: WO2019/173559
PCT Pub. Date: Sep. 12, 2019

(65) Prior Publication Data

US 2021/0049992 A1 Feb. 18, 2021

Related U.S. Application Data

(60) Provisional application No. 62/639,699, filed on Mar. 7, 2018.

(51) Int. Cl.
*G10K 11/00* (2006.01)
*H01F 1/44* (2006.01)
(Continued)

(52) U.S. Cl.
CPC ..... *G10K 11/002* (2013.01); *H01F 1/447* (2013.01); *H04R 9/025* (2013.01); *H04R 9/045* (2013.01); *H04R 9/047* (2013.01)

(58) Field of Classification Search
CPC .... G10K 11/175; G10K 11/002; H04R 27/00; H04R 13/02; H04R 1/1041; H04R 1/06;
(Continued)

(56) References Cited

U.S. PATENT DOCUMENTS 4,951,023 A 8/1990 Erd et al.
8,155,371 B2 4/2012 Wu et al.
(Continued)

FOREIGN PATENT DOCUMENTS

CN 105392092 3/2009
CN 201995123 9/2011
(Continued)

OTHER PUBLICATIONS

International Preliminary Report of PCT/US2019/021095 dated Sep. 8, 2020, 7 pages.
(Continued)

*Primary Examiner* — Ahmad F. Matar
*Assistant Examiner* — Sabrina Diaz
(74) *Attorney, Agent, or Firm* — Brooks Kushman P.C.

(57) ABSTRACT

A loudspeaker is provided with a motor assembly having at least one planar coil and first and second magnets magnetized in a magnetized direction perpendicular to direction of coil movement and perpendicular to a central axis of radiation of the loudspeaker. Ferrofluid is disposed between a diaphragm and the first and second magnets. Third and fourth magnets are disposed outside the first and second magnets and are magnetized in a direction parallel to the direction of coil movement and perpendicular to the magnetized direction of the first and second speakers.

17 Claims, 4 Drawing Sheets

(51) Int. Cl.
*H04R 9/02* (2006.01)
*H04R 9/04* (2006.01)

(58) Field of Classification Search
CPC ... H04R 7/04; H04R 7/12; H04R 7/08; H04R 11/00; H04R 9/025; H04R 9/02; H04R 9/027; H04R 9/022; H04R 9/063; H04R 9/06; H04R 9/045; H04R 9/046; H04R 9/047; H04R 2400/03; A61M 2021/0027; H04K 1/02; H01F 1/447
USPC ..... 381/73.1, 396, 400, 401, 408, 419
See application file for complete search history.

(56) References Cited

U.S. PATENT DOCUMENTS

| | | | | |
|---|---|---|---|---|
| 9,100,738 | B2 | 8/2015 | Voishvillo et al. | |
| 9,942,663 | B1 | 4/2018 | Salvatti et al. | |
| 10,743,097 | B1 | 8/2020 | Cho et al. | |
| 2002/0172392 | A1 | 11/2002 | Iwasa et al. | |
| 2003/0103642 | A1 | 6/2003 | Kam | |
| 2004/0008858 | A1* | 1/2004 | Steere ..... | H04R 9/047 381/398 |
| 2005/0036648 | A1 | 2/2005 | Nguyen et al. | |
| 2005/0157904 | A1 | 7/2005 | Steere et al. | |
| 2008/0205686 | A1 | 8/2008 | Tagami et al. | |
| 2008/0279414 | A1 | 11/2008 | Milot et al. | |
| 2009/0028375 | A1* | 1/2009 | Richoux ..... | H04R 9/025 381/412 |
| 2009/0257617 | A1 | 10/2009 | Ikeda et al. | |
| 2011/0057629 | A1* | 3/2011 | Lin ..... | H02K 35/02 322/3 |
| 2012/0051557 | A1 | 3/2012 | Horigome et al. | |
| 2014/0146995 | A1 | 5/2014 | Adelman | |
| 2014/0161303 | A1 | 6/2014 | Kim | |
| 2014/0219494 | A1 | 8/2014 | Kim | |
| 2015/0010195 | A1 | 1/2015 | Croft, III | |
| 2016/0381462 | A1 | 12/2016 | Wang et al. | |
| 2016/0381463 | A1 | 12/2016 | Wang et al. | |
| 2016/0381481 | A1 | 12/2016 | Wang et al. | |
| 2017/0034628 | A1 | 2/2017 | Mao et al. | |
| 2017/0034629 | A1 | 2/2017 | Mao et al. | |
| 2017/0034631 | A1 | 2/2017 | Wang et al. | |
| 2017/0280247 | A1 | 9/2017 | Kobayashi et al. | |
| 2017/0289693 | A1 | 10/2017 | Wang et al. | |
| 2018/0027332 | A1 | 1/2018 | Mao et al. | |
| 2018/0146294 | A1 | 5/2018 | Zhu et al. | |
| 2018/0184209 | A1 | 6/2018 | Zhu et al. | |
| 2018/0295451 | A1 | 6/2018 | Min et al. | |
| 2018/0220238 | A1 | 8/2018 | Zhu et al. | |

FOREIGN PATENT DOCUMENTS

| | | | | |
|---|---|---|---|---|
| CN | 201995123 U * | 9/2011 | ..... | H04R 9/06 |
| CN | 104883649 A | 9/2015 | | |
| CN | 204993831 U | 1/2016 | | |
| CN | 107360525 A | 11/2017 | | |
| DE | 2759331 | 9/1979 | | |
| DE | 102015103339 A1 * | 9/2016 | ..... | H04R 7/045 |
| JP | S5721200 | 2/1982 | | |
| JP | 2009111484 | 5/2009 | | |
| WO | 2018165280 | 9/2018 | | |

OTHER PUBLICATIONS

1st Office Action for Chinese Application No. 201980017385.3, dated Aug. 18, 2021, 13 Pages.

* cited by examiner

LOUDSPEAKER WITH MAGNETS IN FERROFLUID

CROSS-REFERENCE TO RELATED APPLICATION

This application is the U.S. national phase of PCT Application No. PCT/US19/21095 filed on Mar. 7, 2019, which claims the benefit of U.S. provisional application Ser. No. 62/639,699 filed Mar. 7, 2018, the disclosures of which are hereby incorporated in their entirety by reference herein.

TECHNICAL FIELD

This application relates loudspeakers having a magnet and a moving-coil electrodynamic motor with ferrofluid.

SUMMARY

According to at least one embodiment, a loudspeaker is provided with a speaker frame. A motor assembly is provided in the speaker frame having at least one planar coil. First and second magnets are magnetized in a magnetized direction perpendicular to a direction of coil movement and perpendicular to a central axis of radiation of the loudspeaker. A ferrofluid is provided in the speaker housing to dampen vibrations.

In another embodiment, a diaphragm is connected to at least one of the first and second magnets. The ferrofluid is disposed between the diaphragm and the first and second magnets.

In another embodiment, the ferrofluid is in contact with the diaphragm. In response to the diaphragm vibrating, the ferrofluid dampens resonant frequency vibrations of the diaphragm.

In another embodiment, a membrane surrounds the first and second magnets, wherein the ferrofluid is disposed within the membrane and isolated along surfaces of the magnets.

In another embodiment, third and fourth magnets are disposed outside the first and second magnets and magnetized in a direction parallel to the direction of coil movement and perpendicular to the magnetized direction of the first and second magnets.

In another embodiment, the ferrofluid comprises magnetic particles suspended in a liquid carrier.

In another embodiment, the first and second magnets each have upper and lower large surface faces separated by a narrowest dimension. The first and second magnets are magnetized across the narrowest dimension in first and second magnetized directions being opposite. The planar coil is arranged in a plane along at least one of the upper and lower large surface faces. The direction of coil movement is parallel to the plane of the coil.

In another embodiment, the planar coil has first and second planar coils. The first and second planar coils are each positioned parallel to and along the upper and lower large surfaces respectively.

In another embodiment, the first and second magnets each include at least two magnets spaced apart in a height direction by an air gap. The height direction is perpendicular to the direction of coil movement and perpendicular to the narrowest magnet dimension.

In another embodiment, the first and second magnets are arranged in-line between a front grill and a back wall, wherein a depth of the loudspeaker is defined between the front grill and the back wall.

According to at least one other embodiment, a method of operating a loudspeaker is provided. A motor assembly is provided having first and second magnets each having upper and lower large surface faces separated by a narrowest dimension. The first and second magnets are magnetized across the narrowest dimension in first and second magnetized directions being opposite. A ferrofluid is provided in contact with at least one of the first and second magnets. A first coil is positioned along at least one of the upper and lower large surfaces. The first coil is energized and in in response to energizing, the first coil moves in a direction of coil movement being perpendicular to the first and second magnetized directions. A vibration is dampened with the ferrofluid.

In another embodiment, the method includes arranging first and second magnets in-line in the direction of coil movement.

In another embodiment, the method includes positioning third and fourth magnets outside the first and second magnets. The third and fourth magnets are magnetized in a direction parallel to the direction of coil movement and perpendicular to the first and second magnetized directions.

In another embodiment, the method includes positioning a second coil along at the other of the upper and lower large surfaces. The first and second coils are energized and in response to energizing, the first and second coils move in the direction of coil movement being perpendicular to the first and second magnetized directions.

In another embodiment, the method includes providing the ferrofluid disposed between a diaphragm and the first and second magnets.

According to at least one other embodiment, a loudspeaker is provided having at least one coil. A first set of magnets is magnetized in a first magnetized direction. A second set of magnets is positioned adjacent the first set of magnets and magnetized in a second magnetized direction being opposite the first magnetized direction. The first and second magnetized directions are perpendicular to a direction of coil movement and perpendicular to an axis of radiation of the loudspeaker. The loudspeaker has a diaphragm connected to the coil and a ferrofluid is disposed between the magnets and the diaphragm to dampen vibrations.

In another embodiment, a front grill of the loudspeaker encloses the loudspeaker through which the axis of radiation extends. The first and second magnetized directions are generally parallel to the front grill of the loudspeaker. The axis of radiation is generally parallel to the direction of coil movement. The first set of magnets is positioned closer to the grill than the second set of magnets in the direction of coil movement.

In another embodiment, the at least one coil comprises first and second coils. The first and second coils are separated by the narrowest magnet face dimension.

In another embodiment, the third and fourth magnets disposed outside the first and second magnets and are magnetized in a direction parallel to the direction of coil movement and perpendicular to the magnetized direction of the first and second magnets.

In another embodiment, the diaphragm is positioned closer to the first set of magnets than the second set of magnets.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

An electrodynamic motor in a loudspeaker includes a voice coil and a magnet assembly that generates a constant magnetic field. An alternating current corresponding to electrical signals conveying audio signals is provided to the voice coil. When current flows through the voice coil, the coil interacts with the constant magnetic field and results in movement of the voice coil. This interaction results in the force F, expressed as a product of the magnetic flux density B, the overall length of the voice coil's turns linked to the magnetic flux 1, and the value of the electrical current running through the voice coil I, according to the formula $F=B\cdot I\cdot l$. Due to the force acting on the voice coil wire positioned in the constant magnetic field, the alternating current actuates the voice coil to moves back and forth and, accordingly, moves the diaphragm to which the voice coil (or coil former) is attached. The reciprocating diaphragm produces acoustic signals that propagate as sound waves through air.

One example of a moving coil loudspeaker is U.S. Pat. No. 9,100,738 by Harman International Industries. An example of a loudspeaker using ferrofluid is disclosed in U.S. Pat. No. 7,136,501 by Harman International Industries.

Loudspeakers generally include a motor having a magnet. The magnet has two poles that produce a magnetic field between the two poles. A moving coil is formed by turns of conductive coil. When current flows through the coil, the coil is subject to magnetic field and force is generated which results in movement of the coil. When current flows through the coil, the coil is subject to magnetic field and force is generated which results in movement of the coil in accordance with the formula $F=B\cdot I\cdot L$ (where B is the intensity of induction or magnetic field, I is the intensity of current and L is the length of the conductor subject to the magnetic field).

Figure 1:
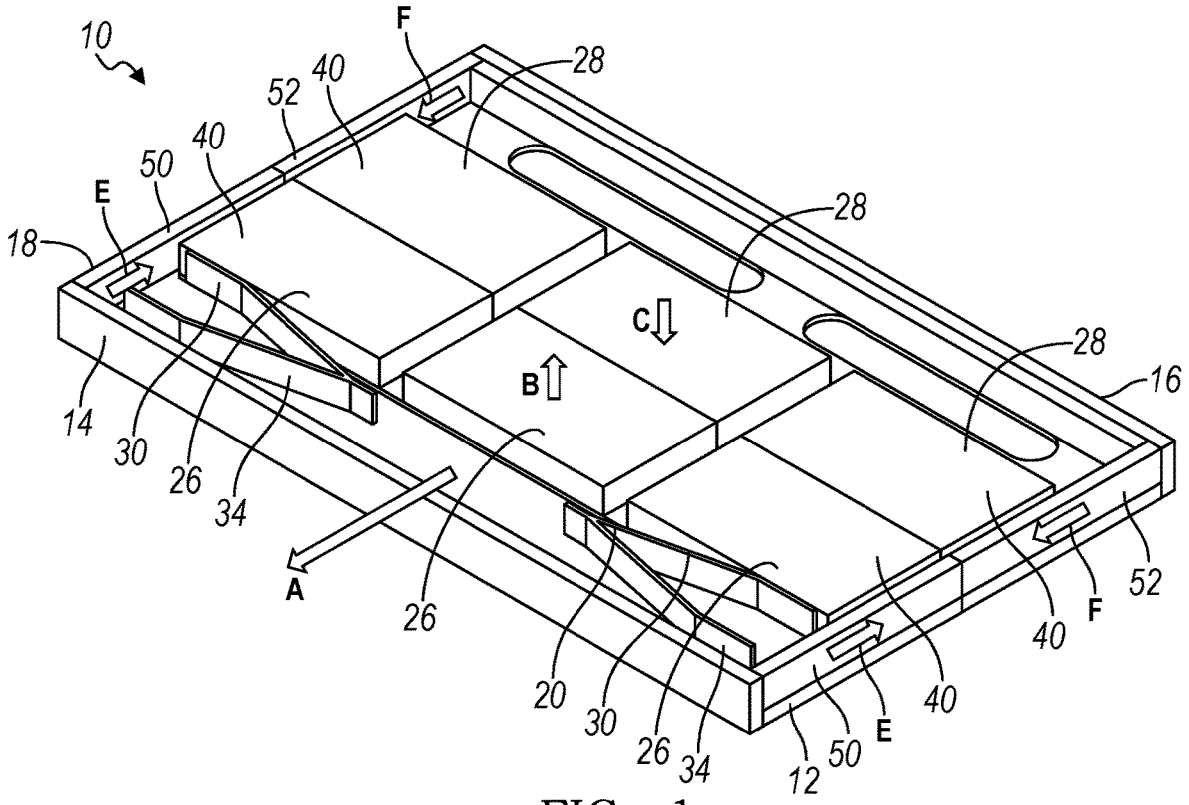
FIG. 1 is a perspective view of a portion of a loudspeaker according to one embodiment.

FIG. 1 illustrates a perspective view of a loudspeaker 10 with a portion of a housing removed in order to view the internal motor and magnet architecture. The housing 12 includes a front grill 14 having a plurality of apertures through which acoustic radiation radiates. The front grill 14 provides protection for other loudspeaker components. The housing 12 also includes a back wall 16 that encloses the rear of the loudspeaker 10. The depth D of the speaker 10 is defined between the front grill 14 and the back wall 16. In one embodiment, the depth D of the loudspeaker 10 may range from 10-25 mm. However other depth dimensions may be possible.

The housing 12 may also have a frame 18 that defines side walls of the loudspeaker 10 and connects the front grill 14 to the back wall 16. As shown in the Figures, the frame 18 may be generally cylindrical and have an elongated oval, or race-track cross section with circular ends connecting elongated sides. In other embodiments, the frame may be elliptical or circular shaped. However, any suitable frame shape may be used.

The loudspeaker 10 includes at least one moving coil 20 connected to a diaphragm 24. The coil 20 moves in direction indicated by arrow A. The direction of movement is generally perpendicular to the front grill 14. A ferrofluid is disposed between the diaphragm and magnets of the electrodynamic loudspeaker in order to dampen the resonance frequency of the device. Co-pending International Application No. PCT/US2018/021319 by Harman International Industries also discloses a loudspeaker with a moving coil, the disclosure of which is hereby incorporated by reference.

A plurality of magnets 26, 28 are mounted to the frame 18. The diaphragm 24 is mounted to the frame 18 and the ferrofluid 32 is disposed between the diaphragm 24 and the magnets 26, 28 and contacts a lower surface 46 of the diaphragm 24. The ferrofluid 32 is in contact with the diaphragm 24 so that as the diaphragm 24 vibrates, the contact with the ferrofluid 32 dampens the vibration.

The ferrofluid is a stable colloidal suspension of sub-domain magnetic particles in a liquid carrier. The ferrofluid dampens the resonant frequency of the diaphragm in order to reduce distortion and smooth frequency response.

The ferrofluid 32 is maintained on the surface of the magnets 26, 28 by the magnetic field attracting the ferrous fluid. A membrane 48 surrounds the magnets 26, 28 in order to isolate the ferrofluid along the surfaces of the magnets 26, 28. The ferrofluid 32 can be provided along all, or only selective magnets. For example, putting ferrofluid only along the outermost magnets 26, 28 may provide sufficient dampening.

The loudspeaker 10 includes planar magnets that are magnetized in direction being perpendicular to the motion of the coil. As shown in FIG. 1, the loudspeaker 10 has a first magnet 26, or set of magnets. The first magnets 26 are magnetized in a direction B being perpendicular to the direction of coil motion A. The loudspeaker 10 has a second magnet 28, or second set of magnets abutting the first magnets 26 and magnetized in a direction C, opposite direction B and also perpendicular to the direction of coil motion A. The magnets 26, 28 are oriented with the smallest face 30 parallel to the front grill 14 and perpendicular to direction A and the movement of the coil 20.

The loudspeaker 10 also includes planar magnets that are magnetized in direction being parallel to the motion of the coil. As shown in FIG. 1, the loudspeaker 10 has a third pair of magnets 50, or set of magnets. The third magnets 50 are magnetized in a direction E being parallel to the direction of coil motion A and away from the front grill 14. The loudspeaker 10 has a fourth pair of magnets 52, or set of magnets abutting the third magnets 50 and magnetized in a direction F, opposite direction E and also parallel to the direction of coil motion A. The magnets 50, 52 are positioned along the side walls of the frame 18 outside of the first and second magnets 26, 28. The magnets 50, 52 are magnetized in directions D, E that intersect adjacent the centerline 56 of the coils 20, 22.

Figure 2:
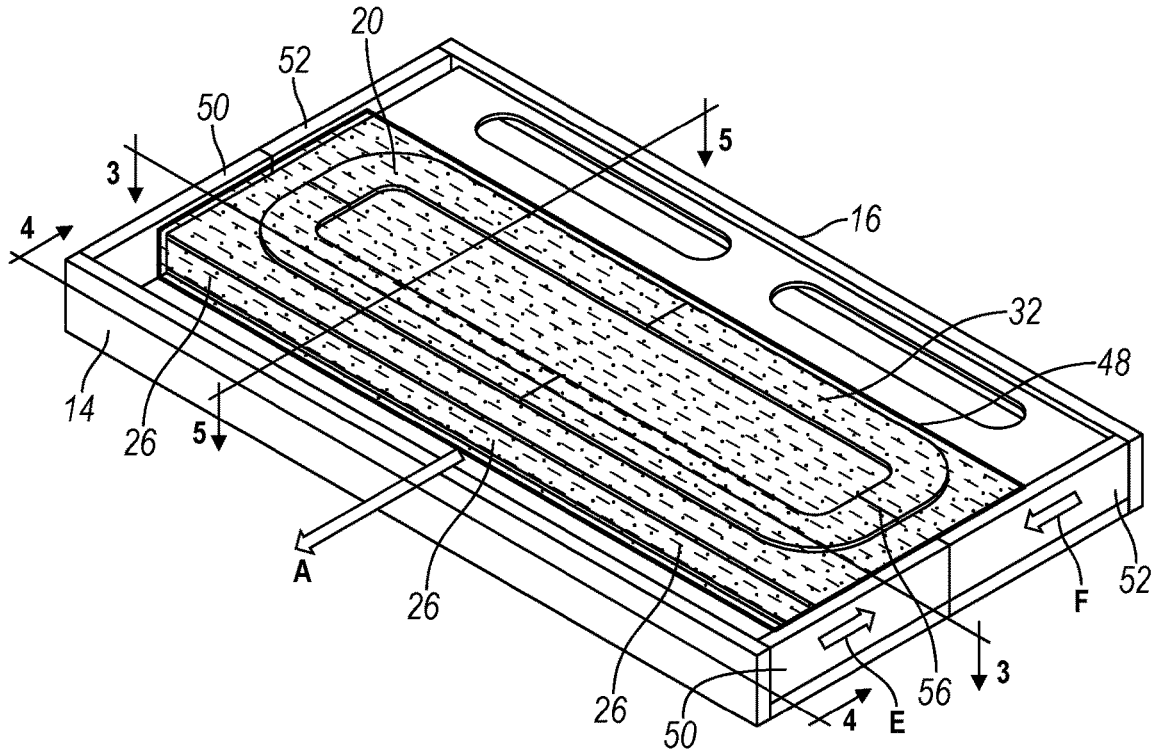
FIG. 2 is another perspective view of a portion of the loudspeaker of FIG. 1.

The loudspeaker 10 may have more than one coil. For example, FIG. 2 illustrates another perspective view of the loudspeaker 10, similar to FIG. 1 but where two moving coils 20 are shown. A first coil 20 is positioned on one side of the magnets 26, 28 and a second coil 22 is positioned on an opposite side of the magnets 26, 28.

Figure 3:
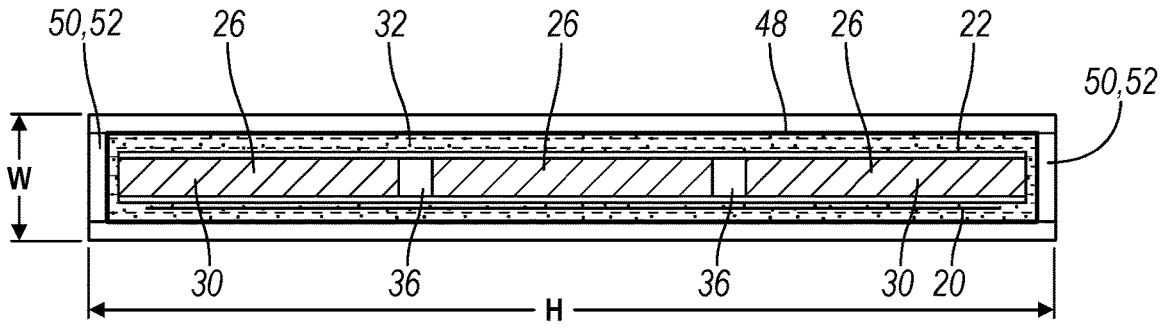
FIG. 3 is a cross-section view of the loudspeaker through section 3-3 of Figure of FIG. 2.

FIG. 3 is a cross-section view of the loudspeaker 10 through section 3-3 of Figure of FIG. 2. As shown in FIG. 3, the magnets 26, 28 are positioned between the two coils 20, 22. The speaker has a narrow width W since the coils are separated by the smallest dimension 30 of the magnets 26, 28. The width W of the speaker, and consequently the front grill opening 14, may be approximately 3 mm. The speaker 10 and front grill opening 14 may have a height H defined between the side walls being approximately 30 mm to 60 mm. The width W and height H may be other suitable dimensions based on speaker characteristics.

Figure 4:
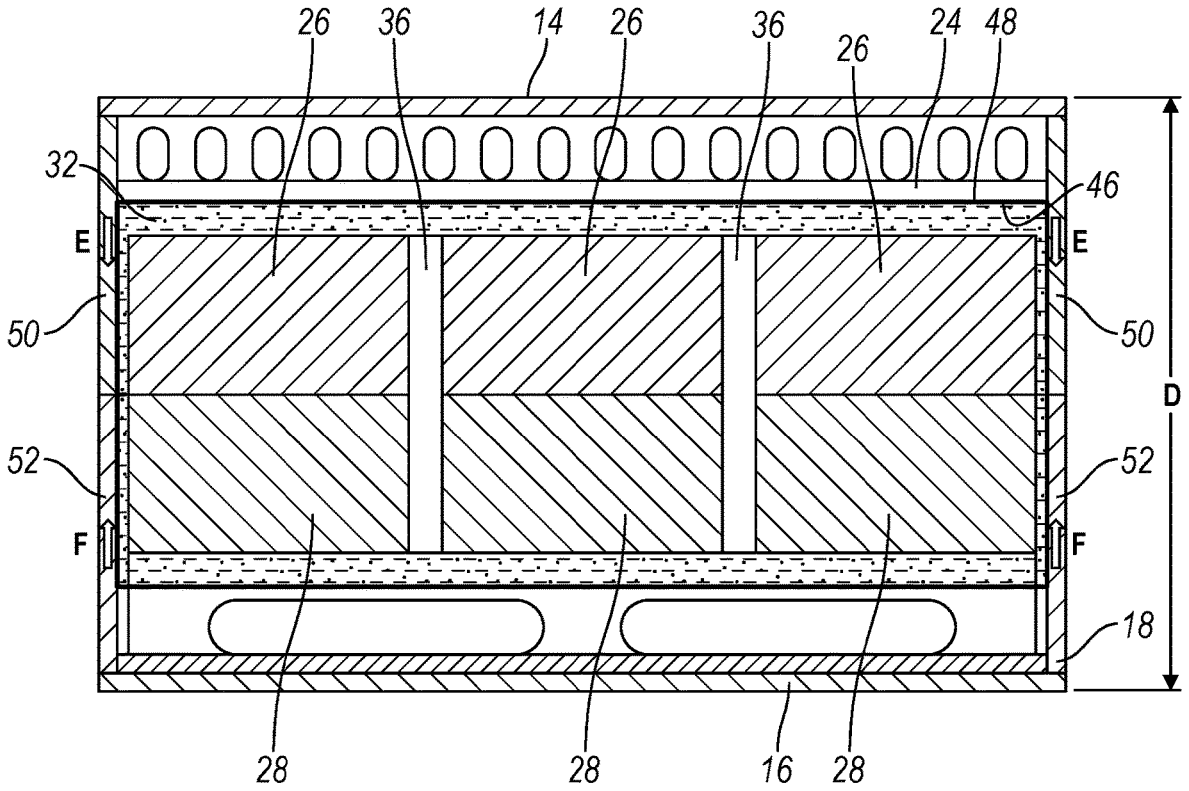
FIG. 4 is a top view of the loudspeaker of FIG. 2 showing a top view of the magnets.

FIG. 4 is top view of the loudspeaker 10 of FIG. 1 showing a top view of the magnets 26, 28 and the loudspeaker 10. The diaphragm 24 is connected to the coils through a former 34 (the coils are not shown in this view). In order to covert force moving the coil 20, 22 into an acoustic pressure wave, the diaphragm 24 is connected and can move the air with the enclosure.

The spaces 36 between the magnets 26, 28 allow for ferrofluid flow as the coils 20, 22 and diaphragm 24 move. The first magnets 26 are positioned parallel and closer to the diaphragm 24. The second magnets 28 are positioned adjacent to the magnets 26 and closer to the back wall 16.

The coils 20, 22 are planar coils oriented parallel to the largest surface 40, 44 of the magnets in order to optimize magnet efficiency since the efficiency of neodymium magnets depends on the surface area. This configuration of magnets and coils also optimizes the force factor (BL factor) for a thin loudspeaker and improves that sound pressure level (SPL) for the same sized driver.

Figure 5:
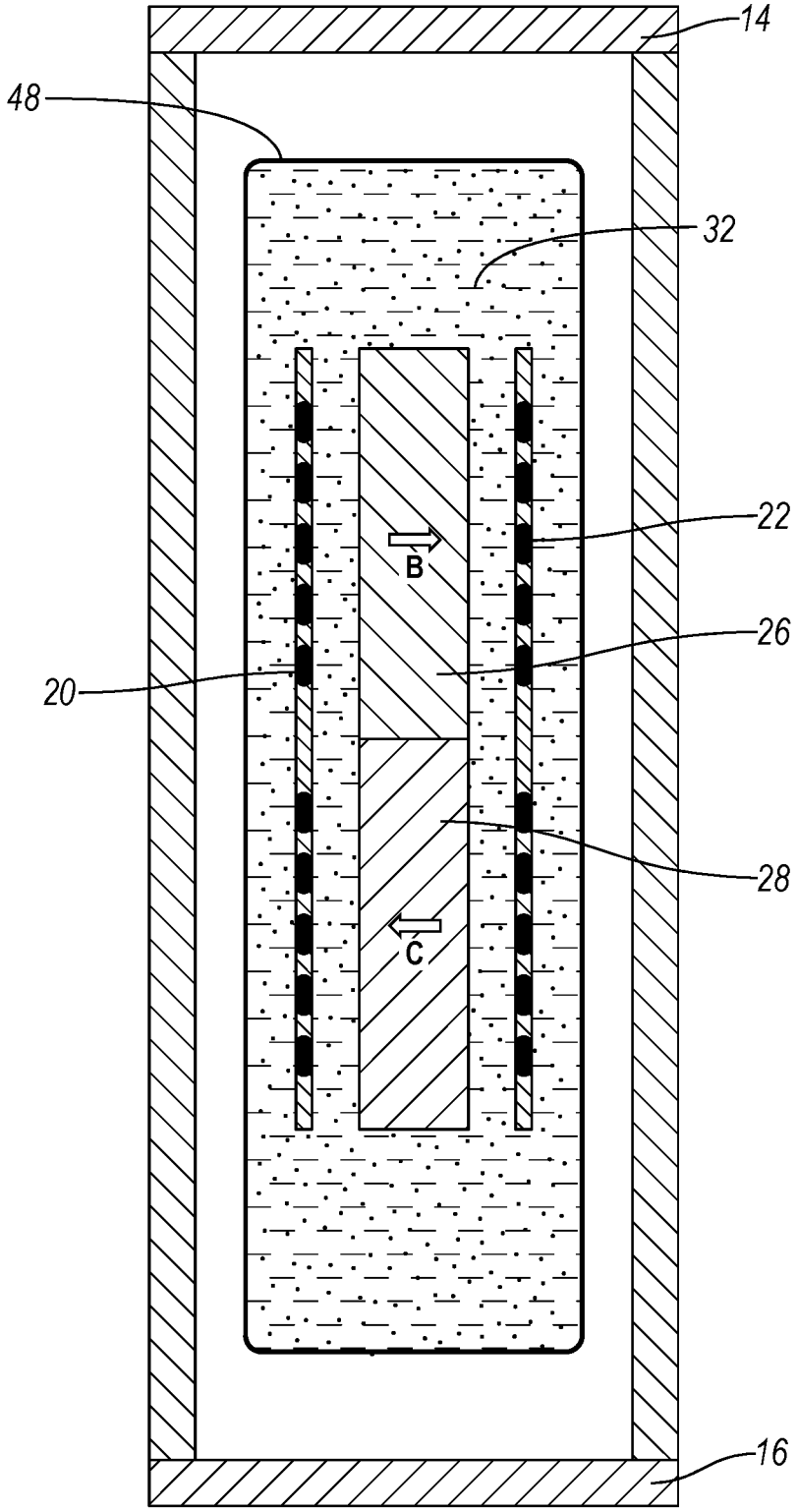
FIG. 5 is a side cross-section view of the loudspeaker through section 5-5 of Figure of FIG. 2.

FIG. 5 is a side cross-section view of the loudspeaker 10 through section 5-5 of Figure of FIG. 2.

The speaker 10 may have coils 20, 22 positioned on each side of the magnets 26, 28. The coils 20, 22 are positioned outboard of the pole pieces 39. In another embodiment, the speaker 10 may only have one coil 20 disposed on one side of the magnets 26, 28. The coils 20, 22 are connected to the diaphragm 24 and move in a direction A. In another embodiment, it is possible to have more than one or multiple coils 20, 22 positioned on one side or both side of the magnet 26, 28.

As shown in FIG. 5, the first magnets 26 are magnetized in a direction B being perpendicular to the direction of coil motion A. The second magnets 28 are magnetized in a direction C, opposite direction B and also perpendicular to the direction of coil motion A. The magnets 26, 28 are magnetized in a direction between the largest faces 40, 44. The magnets 26, 28 are magnetized across the smallest dimension 30.

Figure 6:
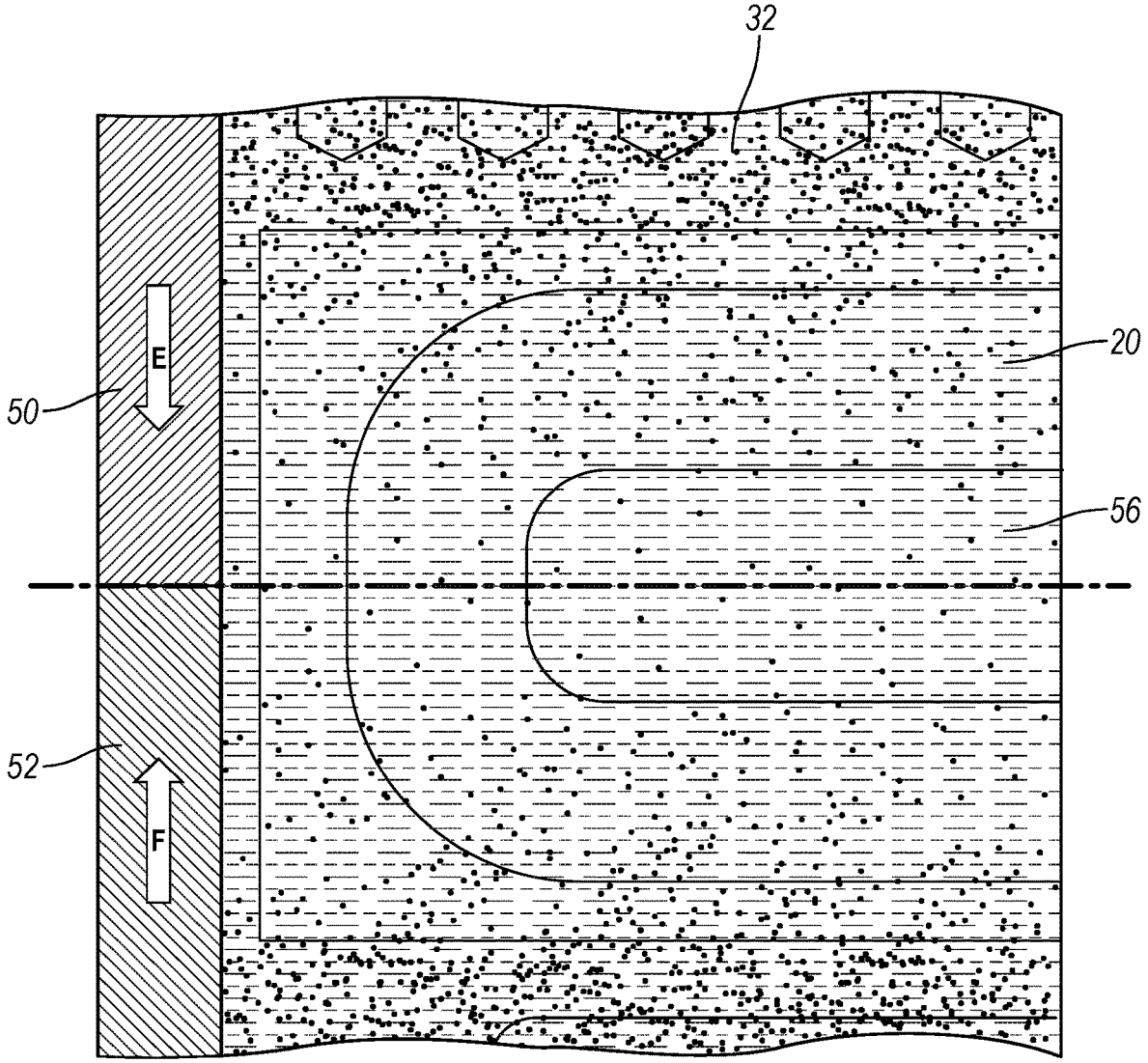
FIG. 6 illustrates the strength of the magnetic field in the ferrofluid.

FIG. 6 illustrates the strength of the magnetic field in the ferrofluid 32 due to the magnets 50, 52. As shown in FIG. 6, the magnetic field is strong along the centerline 56 of the coil.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker comprising:

a speaker frame;

a motor assembly provided in the speaker frame having at least one planar coil; and first and second magnets magnetized in a magnetized direction perpendicular to a direction of coil movement and perpendicular to a central axis of radiation of the loudspeaker;

a ferrofluid provided within the speaker frame to dampen vibrations wherein the ferrofluid surrounds the magnets and is isolated along surfaces of the magnets; and a membrane surrounding the first and second magnets, wherein the ferrofluid is disposed within the membrane and isolated along surfaces of the magnets.

2. The loudspeaker of claim 1, further comprising a diaphragm connected to at least one of the first and second magnets, wherein the ferrofluid is disposed between the diaphragm and the first and second magnets.

3. The loudspeaker of claim 2, wherein the ferrofluid is in contact with the diaphragm, and in response to the diaphragm vibrating, the ferrofluid dampens resonant frequency vibrations of the diaphragm.

4. The loudspeaker of claim 1, further comprising third and fourth magnets disposed outside the first and second magnets and magnetized in a direction parallel to the direction of coil movement and perpendicular to the magnetized direction of the first and second magnets.

5. The loudspeaker of claim 1, wherein the ferrofluid comprises magnetic particles suspended in a liquid carrier.

6. The loudspeaker of claim 1 wherein the first and second magnets each have upper and lower large surface faces separated by a narrowest dimension, wherein the first and second magnets are magnetized across the narrowest dimension in first and second magnetized directions being opposite, wherein the at least one planar coil is arranged in a plane along at least one of the upper and lower large surface faces, wherein the direction of coil movement is parallel to the plane of the coil.

7. The loudspeaker of claim 6, wherein the at least one planar coil comprises first and second planar coils, wherein the first and second planar coils are each positioned parallel to and along the upper and lower large surfaces respectively.

8. The loudspeaker of claim 6, wherein the first and second magnets each include at least two magnets spaced apart in a height direction by an air gap, wherein the height direction is perpendicular to the direction of coil movement and perpendicular to the narrowest magnet dimension.

9. The loudspeaker of claim 1, wherein the first and second magnets are arranged in-line between a front grill and a back wall, wherein a depth of the loudspeaker is defined between the front grill and the back wall.

10. A method of operating a loudspeaker comprising:

providing a motor assembly having first and second magnets each having upper and lower large surface faces separated by a narrowest dimension, wherein the first and second magnets are magnetized across the narrowest dimension in first and second magnetized directions being opposite;

providing a ferrofluid in contact with at least one of the first and second magnets;

providing a membrane surrounding the first and second magnets, wherein the ferrofluid is disposed within the membrane and isolated along surfaces of the first and second magnets;

positioning a first coil along at least one of the upper and lower large surfaces;

energizing the first coil, wherein in response to energizing, the first coil moves in a direction of coil movement being perpendicular to the first and second magnetized directions; and dampening a vibration with the ferrofluid.

11. The method of claim 10, further comprising arranging first and second magnets in-line in the direction of coil movement.

12. The method of claim 10, further comprising:

positioning third and fourth magnets outside the first and second magnets, the third and fourth magnets magnetized in a direction parallel to the direction of coil movement and perpendicular to the first and second magnetized directions.

13. The method of claim 10, further comprising:

positioning a second coil along at the other of the upper and lower large surfaces; and energizing the first and second coils, wherein in response to energizing, the first and second coils move in the direction of coil movement being perpendicular to the first and second magnetized directions.

14. A loudspeaker comprising:

at least one coil;

a first set of magnets magnetized in a first magnetized direction;

a second set of magnets positioned adjacent the first set of magnets and magnetized in a second magnetized direction being opposite the first magnetized direction, wherein the first and second magnetized directions are perpendicular to a direction of coil movement and perpendicular to an axis of radiation of the loudspeaker, a diaphragm connected to the coil;

a ferrofluid surrounding the magnets and isolated along surfaces of the magnets to dampen vibrations; and a membrane surrounding the first and second set of magnets.

15. The loudspeaker of claim 14, further comprising a front grill of the loudspeaker enclosing the loudspeaker through which the axis of radiation extends, wherein the first and second magnetized directions are generally parallel to the front grill of the loudspeaker; and wherein the axis of radiation is generally parallel to the direction of coil movement, wherein the first set of magnets is positioned closer to the grill than the second set of magnets in the direction of coil movement.

16. The loudspeaker of claim 14, wherein the at least one coil comprises first and second coils, wherein the first and second coils are separated by a narrowest magnet face dimension.

17. The loudspeaker of claim 14, further comprising third and fourth magnets disposed outside the first and second magnets and magnetized in a direction parallel to the direction of coil movement and perpendicular to the magnetized direction of the first and second magnets.

* * * * *